United States Patent [19]

Kalinowski

[11] 4,247,592

[45] Jan. 27, 1981

[54] METHOD FOR TREATING SYNTHETIC TEXTILES WITH AMINOALKYL-CONTAINING POLYDIORGANOSILOXANES

[75] Inventor: Robert E. Kalinowski, Auburn, Mich.

[73] Assignee: Dow Corning Corporation, Midland, Mich.

[21] Appl. No.: 129,539

[22] Filed: Mar. 12, 1980

Related U.S. Application Data

[63] Continuation-in-part of Ser. No. 764,674, Feb. 2, 1977, abandoned.

[51] Int. Cl.[3] ..... B32B 27/28; B05D 3/02

[52] U.S. Cl. ..... 428/266; 428/447; 427/387; 427/393.3; 8/DIG. 1; 8/581

[58] Field of Search ..... 8/DIG. 1; 428/447, 266, 428/391; 427/387, 393.3

[56] References Cited

U.S. PATENT DOCUMENTS

| | | | |
|---|---|---|---|
| 2,895,853 | 7/1959 | Bailey et al. | 427/387 |
| 3,303,048 | 2/1967 | Cooper et al. | 427/387 |
| 3,355,424 | 11/1967 | Brown | 260/448 |
| 3,512,915 | 5/1970 | Speir | 8/8 |
| 3,766,115 | 10/1973 | Sands | 8/172 |
| 3,832,228 | 8/1974 | Gardiner et al. | 427/387 |
| 3,910,026 | 10/1975 | Sone et al. | 428/374 |
| 3,962,500 | 6/1976 | Smith | 427/387 |
| 4,020,199 | 4/1977 | Nomura et al. | 427/387 |
| 4,098,572 | 7/1978 | Smith | 428/447 |
| 4,177,176 | 12/1979 | Burrill et al. | 428/447 |

FOREIGN PATENT DOCUMENTS

| | | | |
|---|---|---|---|
| 953058 | 8/1974 | Canada . | |
| 2356895 | 11/1973 | Fed. Rep. of Germany | 8/DIG. 1 |
| 882054 | 10/1957 | United Kingdom | 428/266 |
| 1458319 | 12/1976 | United Kingdom . | |

*Primary Examiner*—Joseph L. Schofer
*Assistant Examiner*—Maria S. Tungol
*Attorney, Agent, or Firm*—George A. Grindahl

[57] ABSTRACT

Synthetic fibers such as polyethylene terephthalate and nylon are treated with certain polydiorganosiloxanes to provide improved properties such as "hand" and water repellency. When the polydiorganosiloxanes contain approximately two silicon-bonded amino radicals of the formula $—R'(NHCH_2CH_2)_aNHR''$, such as $—CH_2CH_2CH_2NHCH_2CH_2NH_2$, they provide a cross-linked siloxane on the surface of the treated fiber, when heated, which does not diminish the fire-retardancy rating of the fibers.

5 Claims, No Drawings

METHOD FOR TREATING SYNTHETIC TEXTILES WITH AMINOALKYL-CONTAINING POLYDIORGANOSILOXANES

BACKGROUND OF THE INVENTION

This application is a continuation-in-part of U.S. application Ser. No. 764,674, filed on Feb. 2, 1977, now abandoned.

This invention relates to a method for durably providing improved properties, such as improved "hand", to synthetic textiles without diminishing the fire-retardancy rating of the textiles, and to the improved textiles obtained therefrom.

Organosilicon compositions are useful for treating textiles to confer desirable properties, such as "hand", antistatic behavior, water repellency and improved tear strength thereto. For example, it is known to apply a curable organopolysiloxane composition, comprising an aminoalkyl-containing organopolysiloxane, to a fabric or fiber and to subsequently cure the applied organopolysiloxane by the action of a curing component to produce a fiber or fabric that is durably surrounded by, i.e. tightly encased in, a coating of cured organopolysiloxane composition.

It is also known to treat synthetic textiles with aminoalkyl-containing organopolysiloxanes without using a crosslinking component for the organopolysiloxane. However, when one uses the aminoalkyl-containing organopolysiloxanes of the art one still obtains a textile whose fibers are durably encased in a coating of cured organopolysiloxane.

An increasingly important deficiency of these textile treatments is the tendency of the resulting cured organosiloxane, which is highly crosslinked, to interfere with the flame-retardant properties of the textile. For example, many fire-retardant synthetic textiles, such as polyethylene terephthalate (PET) textiles and nylon textiles rely on a melting of the ignited textile and a dripping of flaming material to carry away fire and heat from the textile leading to self-extinguishing and a fire-retardant rating. It has been found that the presence of a tightly cured organosiloxane on the surface of such textiles interferes with this melt-drip mechanism and leads to a loss of the fire-retardancy rating of the textile.

SUMMARY OF THE INVENTION

It is an object of this invention to provide a process for treating fire-retardant synthetic textiles to durably provide improved characteristics, such as water repellency, resiliency or "loft", and 37 hand", to the textile without diminishing its fire-retardancy rating.

This object, and others, are achieved by the process of this invention which comprises applying to synthetic textiles certain narrowly defined polydiorganosiloxanes comprising silicon-bonded aminoalkyl radicals and heating the applied polydiorganosiloxane. The resulting treated textile has durably affixed to its surface a lightly crosslinked polydiorganosiloxane which is resistant to removal by washing and provides improved properties, such as "hand", to the textile, surprisingly, without decreasing its fire-retardancy rating.

DESCRIPTION OF THE INVENTION

The present invention relates to a method for treating a fire-retardant synthetic textile without decreasing its fire-retardancy rating, and to the treated textile obtained thereby, said method comprising applying to the surface of said textile a liquid composition consisting essentially of a triorganosiloxane-endblocked polydiorganosiloxane containing an average of up to 100 dimethylsiloxane units and two nitrogen-containing siloxane units per molecule, said nitrogen-containing siloxane units each bearing one amino radical of the formula $-R'(NHCH_2CH_2)_2NHR''$ wherein a is 0 or 1, R' denotes a lower alkylene radical and R'' denotes a hydrogen radical or a lower alkyl radical, all other organic radicals in the polydiorganosiloxane being methyl radicals, and heating the applied triorganosiloxane-endblocked polydiorganosiloxane, thereby providing a fire-retardant synthetic textile having durably affixed to the surface thereof a crosslinked polydiorganosiloxane.

By fire-retardant synthetic textile it is meant herein fiber, filament, thread, yarn, fiberfill, fabric, tow, etc. consisting of a vinylic polymer; such as polyethylene, polypropylene or polyacrylonitrile and/or a condensation polymer; such as polyamide, polyester, polyimide or polycarbonate and/or a cellulose-derived polymer; such as cellulose acetate, and optionally containing one or more of the components commonly included in synthetic textiles; such as delusterents, fire-retardant additives and colorants, which textile is classed as fire-retardant according to the tests hereinafter delineated.

The liquid composition that is applied to a surface of a textile in accordance with this invention consists essentially of a triorganosiloxane-endblocked polydiorganosiloxane, hereinbelow delineated and sometimes denoted as an aminofunctional silicone. The liquid composition may consist solely of the aminofunctional silicone or a liquid composition may be prepared by dissolving or dispersing or emulsifying the aminofunctional silicone in a suitable medium such as an organic liquid or water.

The liquid composition may also contain non-essential components such as pigments, emulsifying agents, fire-retardant additives, plasticizers, anti-static agents and perfumes, when desired.

In many instances it is desirable to apply and durably affix a very small amount, for example, less than 1 percent by weight, based on the weight of the textile, of aminofunctional silicone to a surface of a textile. To this end it is often desirable to prepare a dilute solution or a suspension or an emulsion of the aminofunctional silicone and apply the resulting dilute liquid composition to the textile.

The viscosity of the liquid composition is not critical. The liquid composition should be sufficiently fluid to permit its use in the method of this invention, i.e. it should be applicable to the desired surface of the textile at ambient conditions.

The triorganosiloxane-endblocked polydiorganosiloxane (aminofunctional silicone) consists essentially of terminal triorganosiloxane units of the formula $R_3SiO_{1/2}$ and backbone diorganosiloxane units of the formula $R_2SiO_{2/2}$. Trace amounts of other siloxane units in the aminofunctional silicone, such as $SiO_{4/2}$ and $RSiO_{3/2}$, which are normally present as impurities in commercial polydiorganosiloxanes may be present. Preferably there are no $SiO_{4/2}$ units and $RSiO_{3/2}$ units therein. The R radicals of the above siloxane units are either nitrogen-containing radicals of the formula $-R'(NHCH_2CH_2)_aNHR''$ or methyl radicals. In the above formula R' denotes a lower alkylene radical of the general formula $-C_nH_{2n}-$, such as $-CH_2-$, $-CH_2CH_2-$, $-CH_2CH_2CH_2-$, $-CH_2CH(CH_3)C-$ $H_2$—, and —$(CH_2)_4$—. In the above formula n may have a value of from 1 to 8, preferably 3 to 8 inclusive. Aminofunctional silicones wherein the silicon-bonded, nitrogen-containing radicals have a propylene radical or an alkylated propylene radical, such as —$CH_2CH(CH_3)CH_2$—, as the R′ radical are preferred because of ease of synthesis and availability.

R″ denotes a hydrogen radical, which is a preferred R″ radical, or a lower alkyl radical of the general formula —$C_mH_{2m+1}$ such as methyl, ethyl, propyl, butyl and isobutyl. In the above formula m may have a value of from 1 to 6, inclusive.

It is to be understood that trace amounts of other monovalent R radicals may be present in the aminofunctional silicone as impurity radicals, such as radicals resulting from the particular method of preparation of said silicone, hereinafter recited. For example, a convenient method for preparing aminofunctional silicones comprises reacting a suitable amine with a siloxane or silane which bears a chloropropyl radical. A large percentage of the chloropropyl radicals are thereby converted to amino-substituted propyl radicals, any unconverted chloropropyl radicals remaining as said impurity radicals. Preferably there are none of said impurity radicals in the aminofunctional silicone.

In accordance with the above, triorganosiloxane-endblocked polydiorganosiloxanes suitable for use in the process of this invention consist essentially of siloxane units selected from the following: $R''NH(CH_2CH_2NH)_aR'(CH_3)_2SiO_{1/2}$, $R''NH(CH_2CH_2NH)_aR'(CH_3)SiO_{2/2}$, $(CH_3)_3SiO_{1/2}$ and $(CH_3)_2SiO_{2/2}$ siloxane units. The preferred nitrogen-containing radical is —$CH_2CH_2CH_2NHCH_2CH_2NH_2$ thereby giving rise to preferred nitrogen-containing siloxane units of the formulae $H_2NCH_2CH_2NHCH_2CH_2CH_2Si(CH_3)_2O_{1/2}$ and $H_2NCH_2CH_2NHCH_2CH_2CH_2Si(CH_3)O_{2/2}$.

The triorganosiloxane-endblocked polydiorganosiloxane contains an average of two nitrogen-containing siloxane units and from zero to 100, preferably 50 to 100, dimethylsiloxane units per molecule. Aminofunctional silicones having a greater number of nitrogen-containing siloxane units and/or appreciably more than 100 dimethylsiloxane units per molecule appear to interfere with the melt-drip behavior of synthetic textiles and are thus not contemplated by this invention. The two nitrogen-containing siloxane units may be terminal and/or backbone siloxane units, as desired.

Methods for preparing the triorganosiloxane-endblocked polydiorganosiloxane polymers that are employed according to this invention are well known in the art. Thus, a triorganosiloxane-endblocked polydiorganosiloxane bearing an average of 2 suitably reactive groups per molecule, such as ≡SiH or $\equiv SiCH_2CH_2CH_2Cl$, may be reacted with $CH_2{=}C(CH_3)CH_2NH_2CH_2NH_2$ or $H_2NCH_2CH_2NH_2$, respectively, to provide an analogous polydiorganosiloxane wherein the reactive groups have been converted to —$CH_2CH(CH_3)CH_2NHCH_2CH_2NH_2$ groups and $CH_2CH_2CH_2NHCH_2CH_2NH_2$ groups, respectively. Small amounts of unreacted ≡SiH or $\equiv SiCH_2CH_2CH_2Cl$ groups may remain as impurity groups, as hereinbefore discussed. Alternatively, a suitable aminofunctional silicone may be prepared from aminoalkyl-substituted silanes or siloxanes using well-known methods of hydrolysis and equilibration. For example, Pike, et al., U.S. Pat. No. 3,033,815, Speier, U.S. Pat. No. 3,146,250 and Brown, U.S. Pat. No. 3,355,424 contain teachings which may be adapted to prepare aminofunctional silicones which are suitable for use in the method of this invention. The above patents to Pike, et al., Speier and Brown are hereby incorporated by reference to show the preparation of triorganosiloxane-endblocked polydiorganosiloxanes suitable for use in the method of this invention.

A highly preferred triorganosiloxane-endblocked polydiorganosiloxane for the method of this invention may be prepared by hydrolyzing $H_2NCH_2CH_2NHCH_2CH_2CH_2Si(CH_3)(OCH_3)_2$ in excess water and equilibrating the resulting hydrolyzate with dimethylcyclopolysiloxane and decamethyltetrasiloxane using a base catalyst such as KOH, to provide a polydiorganosiloxane having about 100 siloxane units, 2 of which bear an $H_2NCH_2CH_2NHCH_2CH_2CH_2$— radical.

A highly preferred liquid composition for the method of this invention may be prepared by preparing a dilute aqueous emulsion of the above highly preferred aminofunctional silicone, using a suitable emulsifying agent such as a non-ionic emulsifying agent.

In the method of this invention, the liquid composition may be applied to a surface of the textile in any suitable manner such as by brushing, rinsing, padding, dipping and spraying.

In the method of this invention the applied liquid composition is heated to a temperature of from above room temperature to less than the melting or decomposing temperature of the synthetic textile. Heating may be done at any convenient time providing the textile is in contact with at least the aminofunctional silicone for an effective length of time. By an effective length of time, it is meant a span of time at the particular heating temperature that is sufficient to allow the aminofunctional silicone to be crosslinked and durably affixed to the surface of the textile. Thus, the liquid composition must be exposed to said temperature during or after the applying of the liquid composition to the surface of the textile.

Heating may be done by any suitable method or combination of methods such as infrared radiation; a suitable hot fluid such as hot air or steam; electrical heating elements and microwave heating. Alternately, the liquid may be applied to a hot textile.

It has been found that the preferred aminofunctional silicone described above will crosslink on the surface of a synthetic textile at temperatures as low as approximately 50° C. For example, the method of this invention is useful as a fabric softening method in a clothes washing procedure at 50° to 70° C., such as in the rinse and dry cycle of an automatic washer.

After the textile has been treated, i.e. has had the liquid composition applied and has been heated to a suitable temperature as described above, the aminofunctional silicone is crosslinked and is durably affixed to the surface of the textile.

By durably affixed it is meant that the crosslinked aminofunctional silicone cannot be washed from the surface of the textile to a non-detectable level by 10 machine washings according to AATCC 124-1973 test method, herein incorporated by reference. By crosslinked it is meant that the durably affixed aminofunctional silicone cannot be melted or dissolved in toluene after being separated from the textile, such as by melting or dissolving the textile.

It should be understood that the method of this invention may be used to modify an end-product, synthetic textile or an intermediate synthetic textile. For example, it is within the scope of this method to modify a synthetic fiber or filament at any suitable point during or after its preparation and subsequently fabricate an article such as a yarn or a fabric or a garment from said modified fiber or filament. Alternately, a fabric or a garment may be fashioned from a synthetic fiber or filament and, subsequently, at least the synthetic fiber portion of said fabric may be modified by this method.

The process of this invention is further illustrated by the following examples which teach the best mode for carrying out the invention; however, said examples should not be regarded as limiting the invention which is delineated by the appended claims. All parts and percentages are by weight unless otherwise stated.

The flame-retardancy rating of a textile is determined by Department of Commerce Test No. FF5-74, hereby incorporated by reference herein. In this test, 5 textile samples, 1" wide×10" long are suspended in a vertical position and ignited with a lazy yellow burner flame. To pass this test none of five samples can burn its entire length and any char formed must not exceed 7" in length.

EXAMPLE 1

A aminofunctional silicone having the formula $Me_3SiO(Me_2SiO)_{98}(MeZSiO)_2SiMe_3$, wherein Me denotes $CH_3$ and Z denotes $—CH_2CH_2CH_2NHCH_2CH_2NH_2$ was emulsified using a blend of 66.9 parts water, 1.8 parts of Tergitol® TMN-6 brand of trimethylnonyl polyethyleneglycol ether non-ionic surfactant and 1.3 parts Igepal® CA-897 brand of octylphenoxy poly(ethyleneoxy)ethanol non-ionic surfactant for every 30 parts of the silicone. The silicone was mixed with the water-surfactant blend using mechanical mixing and the mixture was homogenized twice at 6000 psi. The resulting 30 weight percent silicone emulsion was diluted with water as needed for the following examples. Weighed samples of prewashed and dried polyethylene terephthalate (PET) and nylon knit fabrics were padded using the above emulsions of varying concentration. The padded samples were heated at 204° C. and 180° C., respectively, for 90 seconds, washed for 15 minutes at 77° C. with a 0.1 percent solution of Triton® X-100 brand of octylphenoxy polyethoxy ethanol, rinsed, air dried and reweighed to determine the percent of silicone add-on. Table I summarizes these data. All treated samples exhibited good "hand" and AATCC spray ratings of 70 to 80.

The prewashed and dried PET and nylon samples, as well as the treated samples having 4.5 weight percent add-on were tested for flame retardancy according to DOC FF 5-74. Although the melt-drip behavior of the treated samples was reduced, compared to the untreated fabrics, the samples were self-extinguishing by a combination of melt-drip behavior and charring, thereby retaining a PASS fire-retardancy rating. The treated samples were extracted with an equal volume mixture of phenol and o-dichlorobenzene which dissolved the fabrics and left a crosslinked, insoluble polydiorganosilicone residue which could not be melted at temperatures as high as 350° C. Extraction of the untreated samples left no organic residue.

TABLE I

| Bath Concentrations (W % Silicone) | Add-On (W % of Fabric) Nylon 6 | PET |
|---|---|---|
| 0.5 | 3.5 | 1.0 |
| 2.5 | 4.5 | 2.5 |
| 5.0 | 6.5 | 4.5 |
| 10.5 | 13.0 | 7.0 |

EXAMPLE 2

Nylon 6 knitted fabric, Acetate/PET-(68/32) knitted fabric and PET woven fabric were washed in an automatic clothes washer wherein from 10 to 50 grams of the 30 percent silicone emulsion of Example 1 was automatically added to the washer during the rinse cycle. The washed and treated samples had improved "hand" and were self-extinguishing in the DOC FF 5-74 flammability test.

EXAMPLE 3

Several samples of a blue print, chemically fire-retarded PET woven fabric, treated as in Example 1 and having approximately 2.8 weight percent add-on, were subjected to 10 machine washings according to AATCC 124-1973 test method. Although the samples lost approximately 34 percent of the silicone add-on, they experienced no loss of "hand", water repellency or self-extinguishing characteristics. Additional samples of the treated PET fabric were rinsed 10 times with perchloroethylene to determine dry cleaning durability. The rinsed samples lost approximately 80 percent of the silicone add-on and consequently lost "hand" and water repellency.

EXAMPLE 4

PET fiberfill was treated as in Example 1 with bath concentrations of 0.5 and 2.0 percent silicone, producing add-ons of less than 0.1 and 4.5 weight percent, respectively. The sample of fiberfill having less than 0.1 weight percent add-on possessed better "hand" and resiliency than Dacron® II brand fiberfill. Flammability of the untreated fiberfill, the two treated fiberfill samples and Dacron® II brand fiberfill was evaluated in two ways. In a Pan Burn test 0.3 g. of sample was placed in a 5.6 cm. diameter×2.0 cm. deep aluminum cup and the sample was ignited with a 1" lazy yellow bunsen flame for 3 seconds. The burn time of the sample after the burner was removed was noted. In a combined Vertical Burn and Fragment Burn test 0.3 g. of sample was fashioned into a 1"×5" wad and suspended over an aluminum cup to collect burning fragments and the sample was ignited at the bottom end with a 1" lazy yellow bunsen flame for 3 seconds. Burn time for the sample and for the fragments after the burner was removed were noted. Table II summarizes these data which show that fiberfill samples which have been treated by the method of this invention have flammability characteristics which are little different from the flammability of untreated fiberfill, but better than conventionally treated fiberfill.

TABLE II

| Sample | Burn Time (seconds) Pan Burn | Vertical Burn | Fragment Burn |
|---|---|---|---|
| Untreated fiberfill | 15 | 3 | 7 |
| Dacron® II treated fiberfill | 26 | 11 | 26 |
| Fiberfill (<0.1 weight percent Add-on) | 3 | 7 | 7 |

TABLE II-continued

| Sample | Burn Time (seconds) Pan Burn | Vertical Burn | Fragment Burn |
|---|---|---|---|
| Fiberfill (4.5 weight percent Add-on) | 8.5 | 8 | 8 |

was normalized on a basis of zero add-on for the control.

The thus-treated samples were further evaluated for "hand" and flammability according to DOC Test No. FF 5-74 except that the samples were 1" wide×4" long instead of 1" wide×10" long. The results, summarized in Table III, shows the critical limitations that must be placed on the structure of an aminofunctional silicone that is used to treat a synthetic textile if melt-drip behavior is to be preserved.

TABLE III

| Aminofunctional Silicone (0.5% in $CCl_2{=}CCl_2$) | Add-on W % | Hand | Flammability Rating - Samples Burned/Tested |
|---|---|---|---|
| None | 0 | Good | Pass - 0/6 |
| $Me_3SiO(Me_2SiO)_{49}(MeZSiO)SiMe_3$ | 2.53 | Excellent | Pass - 0/6 |
| $Me_3SiO(Me_2SiO)_{392}(MeZSiO)_{7.7}SiMe_3$ | 2.34 | Excellent | Fail - 6/6 |
| $Me_3SiO(Me_2SiO)_{48}(MeZSiO)_2SiMe_3$ | 3.14 | Excellent | Pass - 1/6 |
| $Me_3SiO(Me_2SiO)_{398}(MeZSiO)_{2.2}SiMe_3$ | 4.69 | Excellent | Fail - 2/6 |
| $Me_3SiO(Me_2SiO)_{98}(MeZSiO)_2SiMe_3$ | 2.56 | Excellent | Pass - 1/6 |

EXAMPLE 5

When the siloxane in Example 1 was replaced with a siloxane of the same formula but with Z denoting $-CH_2CH_2CH_2NHCH_3$, and the method of this invention repeated, substantially similar results were obtained.

EXAMPLE 6

When Example 1 was repeated with a fire-retardant modacrylic "fake" fur, a fire-retardant fur having improved "hand" and resiliency was obtained. In addition, the treated fur could be laundered without experiencing the usual matting.

EXAMPLE 7

A polyethylene terephthalate fabric containing a fire-retardant additive was scoured for ten minutes in an automatic washer at 50° C. using 50 grams of detergent and 12.8 gallons of water. The scoured fabric was then rinsed and dried at 107° C. for 10 minutes. Weighed samples of the thus-cleaned fabric were dipped in perchloroethylene baths containing 0.5 percent of the aminofunctional silicone (Z denotes $H_2NCH_2CH_2NHCH_2CH_2CH_2-$) shown in Table III, nipped between rollers at 40 psi pressure, and then dipped and nipped again. The samples, which contained about 100 percent by weight pick-up after the final nipping, were dried at 107° C. for 10 minutes, heated further at 204° C. for 90 seconds, rescoured and redried as above and reweighed to determine add-on of aminofunctional silicone. Percent add-on was calculated to allow for the weight loss incurred by the control and That which is claimed is:

1. A method for treating a fire-retardant synthetic textile without decreasing its fire-retardancy rating, said method comprising applying to the surface of said textile a liquid composition consisting essentially of a triorganosiloxane-endblocked polydiorganosiloxane containing an average of up to 100 dimethylsiloxane units and two nitrogen-containing siloxane units per molecule, said nitrogen-containing siloxane units each bearing one amino radical of the formula $-R'(NHCH_2CH_2)_aNHR''$ wherein a is 0 or 1, R' denotes a lower alkylene radical and R'' denotes a hydrogen radical or a lower alkyl radical, all other organic radicals in the polydiorganosiloxane being methyl radicals, and heating the applied triorganosiloxane-endblocked polydiorganosiloxane, thereby providing a fire-retardant synthetic textile having durably affixed to the surface thereof a crosslinked polydiorganosiloxane.

2. A method according to claim 1 wherein a has a value of 1, R' has the formula $-CH_2CH_2CH_2-$ and R'' is hydrogen.

3. A method according to claim 2 wherein the synthetic textile is a nylon textile or a polyethylene terephthalate textile.

4. A method according to claim 3 wherein the triorganosiloxane-endblocked polydiorganosiloxane is heated to a temperature of from 50° C. to 250° C. after it has been applied to the synthetic textile.

5. A synthetic textile produced by the method of claim 1.

* * * * *

UNITED STATES PATENT AND TRADEMARK OFFICE

CERTIFICATE OF CORRECTION

PATENT NO. : 4,247,592

DATED : January 27, 1981

INVENTOR(S) : Robert E. Kalinowski

It is certified that error appears in the above-identified patent and that said Letters Patent are hereby corrected as shown below:

In Column 1, line 51; the line reading "lency, resiliency or "loft", and 37 hand", to the textile" should read "lency, resiliency or "loft", and "hand", to the textile".

Signed and Sealed this

*First* Day of *September 1981*

[SEAL]

*Attest:*

GERALD J. MOSSINGHOFF

*Attesting Officer*

*Commissioner of Patents and Trademarks*